United States Patent [19]

Hooper

[11] 4,268,381

[45] May 19, 1981

[54] ROTARY PULP SCREENING DEVICE OF THE VERTICAL PRESSURE TYPE

[75] Inventor: Anthony W. Hooper, Montreal, Canada

[73] Assignee: Uniweld Inc., West Sherbrooke, Canada

[21] Appl. No.: 35,515

[22] Filed: May 3, 1979

[51] Int. Cl.[3] ..... B07B 1/20

[52] U.S. Cl. ..... 209/273

[58] Field of Search ..... 209/273, 306, 270; 210/219, 413, 456

[56] References Cited

U.S. PATENT DOCUMENTS

| | | | |
|---|---|---|---|
| 817,333 | 4/1906 | Orrman | 209/273 |
| 3,081,873 | 3/1963 | Cowan et al. | 209/273 |
| 3,243,041 | 3/1966 | Cowan et al. | 209/273 |
| 3,363,759 | 1/1968 | Clark-Pounder | 209/273 |
| 3,437,204 | 4/1969 | Clark-Pounder | 209/273 |
| 3,508,651 | 4/1970 | Hooper | 210/65 |
| 3,637,077 | 1/1972 | Cowan et al. | 209/273 |
| 3,713,536 | 1/1973 | Hooper | 209/273 |
| 3,933,649 | 1/1976 | Ahlfors | 209/273 X |
| 3,970,548 | 7/1976 | Seifert et al. | 209/273 X |

*Primary Examiner*—William A. Cuchlinski, Jr.
*Attorney, Agent, or Firm*—Larson, Taylor and Hinds

[57] ABSTRACT

A rotary pulp screening device is disclosed which is less sensitive to variation in pulp flow, pulp consistency and pressure than existing pulp screens. The device is of the vertical pressure type and includes a cylindrical housing having an upper inlet chamber and a lower screening chamber with a disc ring dividing the upper chamber from the lower chamber, an inlet aperture in the upper chamber, a cylindrical screen mounted within the lower chamber, a rotary impeller mounted for rotation about a central vertical axis within the screen, the impeller being approximately in the form of a paraboloid, means for rotating the impeller, impeller blades radiating from the impeller and extending to within a short distance of the screen over the length of the screen, at least two dilution systems for diverting dilution water into different areas of the screen and a pulp discharge outlet from the lower chamber outside the pulp screen.

19 Claims, 12 Drawing Figures

ROTARY PULP SCREENING DEVICE OF THE VERTICAL PRESSURE TYPE

The present invention relates to rotary screening of pulp slurry and more particularly to improvements in a rotary pulp screening device of the vertical pressure type.

A pulp screening device of the vertical pressure type was disclosed in U.S. Pat. No. 3,713,536, issued Jan. 30, 1973. The pulp screening device of this patent was a clear advance in the art over the old gravity type screens because it was a pressurized screen and allowed a larger flow of pulp to be screened.

It has now been found that a number of substantial improvements may be made to the pressure pulp screening device shown in U.S. Pat. No. 3,713,536 which improve the capacity of the pulp screening device by achieving a substantially stable hydraulic flow of pulp slurry to the screen over a wide operating range. The pulp screening device of the present invention is less sensitive to variations in flow, pulp consistency and pressure. A stabilized hydraulic flow through the pulp screening device permits a stable fiber flow through the pulp screen. In the pressure pulp screening device described in U.S. Pat. No. 3,713,536 the pulp slurry enters at a tangential inlet and swirls around in the upper pulp stock inlet chamber, passes over the lip of the inlet ring, and flows downwards into the lower pulp stock screening chamber. This swirling action tends to form a vortex at the center of the inlet ring which reduces the amount of pulp slurry that flows through the inlet ring into the screening chamber. In the screening device shown in U.S. Pat. No. 3,713,536 the top of the impeller is a flat disc and the pulp slurry has to pass over the edge of the impeller before flowing downwards between the peripheral surfaces of the impeller and the screen.

Cowan et al in U.S. Pat. No. 3,081,873 shows a horizontal pulp screen which has two dilution water supplies leading to the pulp screen in different areas. Cowan suggests that one dilution water supply cleans the pulp and the other supply carries away the reject material. The present invention provides multiple dilution water supplies to different areas down the vertical screen face to aid in passing the fibers through the screen.

It is one purpose of the present invention to provide a rotary pulp screening device of the vertical pressure type which has a greater capacity of pulp slurry flow through the screen for the same amount of power necessary to drive the rotary impeller.

It is a further purpose of the present invention to provide a pulp screening device of the vertical pressure type which provides a substantially stable hydraulic flow and hence stable fiber flow through the pulp screen over a wide operating range covering variations in flow, pulp consistency and pressure.

These and other purposes are achieved by providing a rotary pulp screening device of the vertical type including a cylindrical housing, and having an upper inlet chamber wherein the pulp slurry passes into the chamber through an inlet aperture and a lower screening chamber having a cylindrical screen mounted therein and a pulp discharge outlet outside the screen. A rotary impeller is mounted for rotation within the cylindrical screen, the impeller being in the form of a paraboloid so that the movement of the pulp slurry entering the screening area is unhindered and does not have to pass over an edge or corner. Impeller blades radiate from the impeller extending to within a short distance of the screen over the length of the screen, and a plurality of dilution systems direct dilution water onto different areas of the screen. This enables variation in pressures and flows of dilution water to be applied to the screen where needed.

In a preferred embodiment the inlet aperture extends around at least a portion of the periphery of the cylindrical housing, and a conical inlet ring is provided in the upper chamber extending upwards from a dividing disc ring which divides the upper and lower chambers. The conical inlet ring extends above the inlet aperture so the space between the conical inlet ring and the cylindrical housing is always full of pulp slurry when the screen is in operation. The inlet ring has its smallest diameter at a top lip spaced from a top surface of the cylindrical housing, providing an entry to the lower chamber between the circular lip and the top surface of the housing. The submerged inlet aperture ensures even slurry flow over the circular lip. The circular lip is small thus there is a high axial flow of the slurry through the inlet ring into the screening chamber with little or no radial movement of the slurry. In one embodiment a vortex breaker is provided to ensure the pulp slurry does not swirl as it passes down through the inlet ring. Swirling action can cause a vortex which restricts flow into the screening chamber. The paraboloid shaped impeller directs the pulp slurry towards the screen and the impeller blades gradually increase the radial velocity of the pulp slurry. The gradual increase in radial velocity avoids plugging at the top of the impeller which can occur with abrupt velocity changes or sudden transition of the axial movement of the slurry to radial movement.

In one embodiment a volute casing surrounds the inlet aperture of the cylindrical housing, and a stone trap is attached to the base of the volute casing to allow stones and other debris to be removed.

The impeller may extend for the full length of the pulp screen with the tip of the impeller being level with the top of the screen, or the impeller may be either longer or shorter than the screen so that the tip of the impeller is above or below the top of the screen.

In another embodiment of the invention, a reject chamber is provided with a tangential discharge to ensure the rejects are pumped out of the reject chamber. Furthermore, in yet another embodiment a modular construction of the reject chamber is provided to permit easy removal from the screening device, and allow the reject chamber to be cleaned out more easily than in existing screening devices of this type.

In drawings which illustrate embodiments of the invention,

Figure 1:
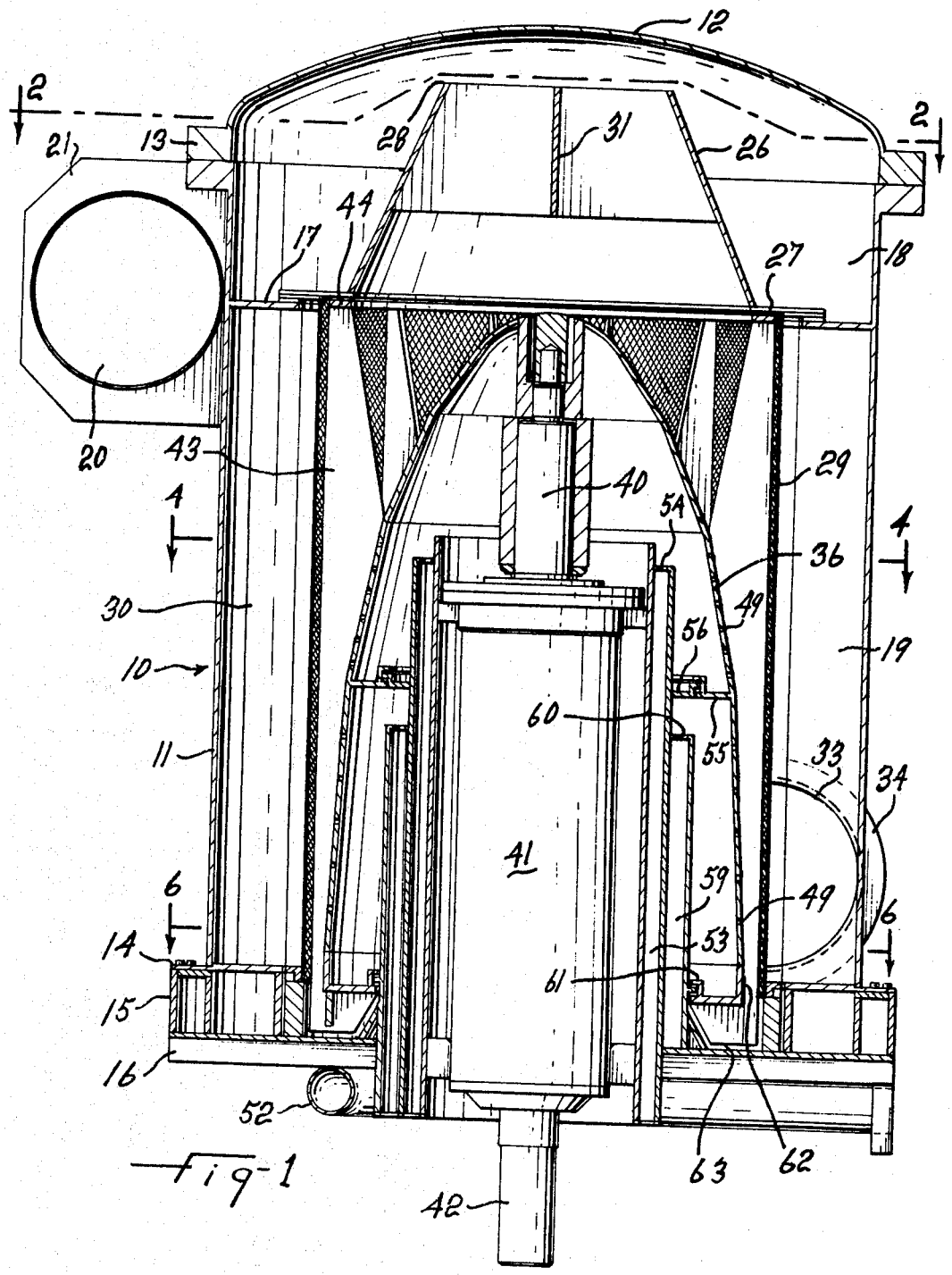
FIG. 1 is a vertical section of one embodiment of the pulp screening device of the present invention.
Figure 2:
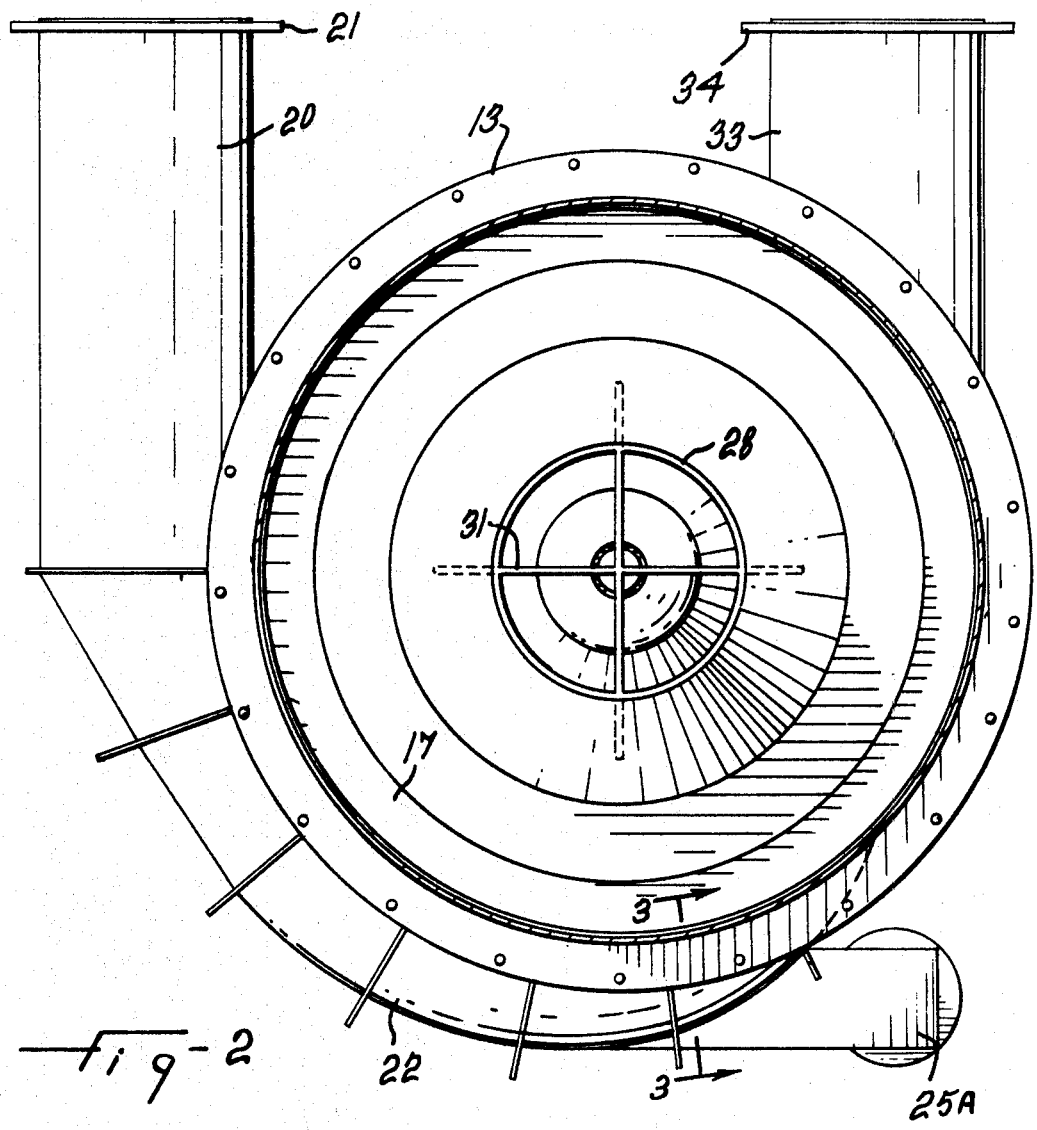
FIG. 2 is a horizontal section at line 2—2 of FIG. 1.

Referring now to FIGS. 1 to 6, one embodiment of a pulp screening device 10 is shown having a generally cylindrical housing 11 with a top cover 12 joined to the cylindrical housing 11 at flange 13. The cylindrical housing 11 has a lower flange 14 which rests on a modular reject chamber 15 supported on a base plate 16.

Figure 3:
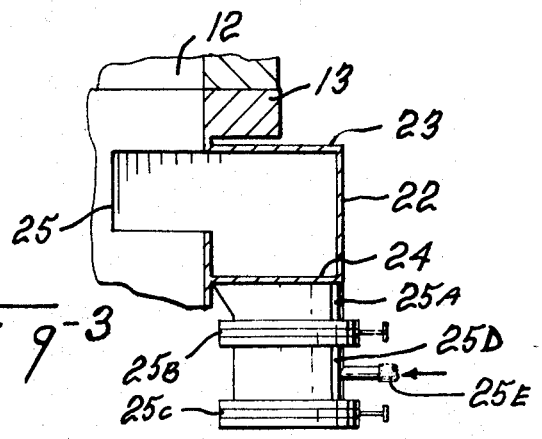
FIG. 3 is a partial section at line 3—3 of FIG. 2.
Figure 4:
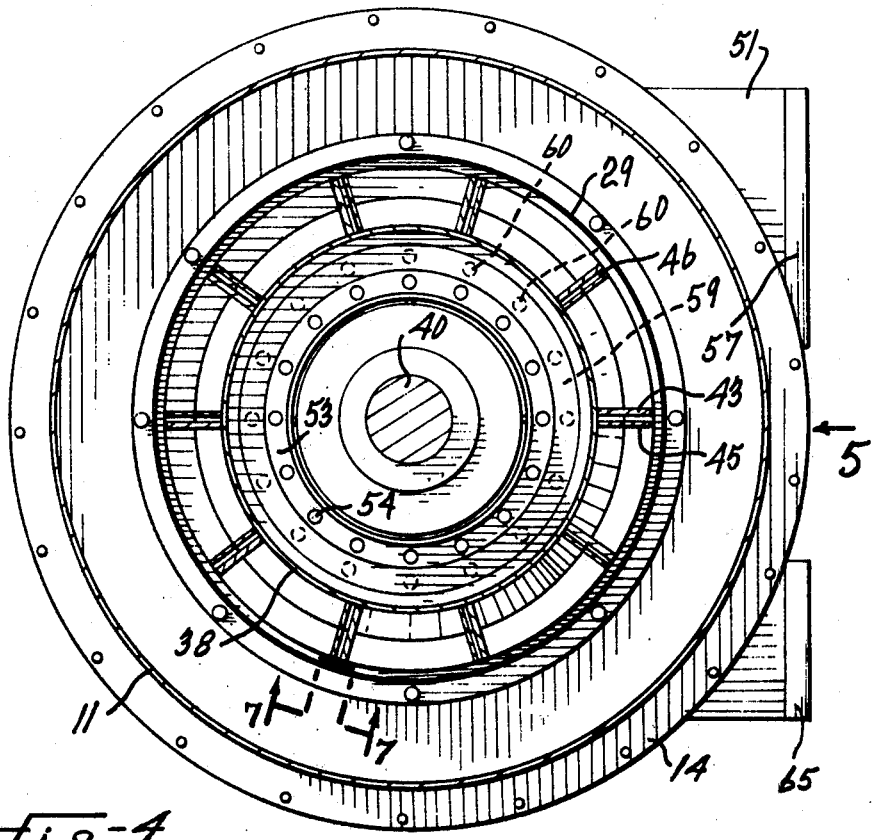
FIG. 4 is a horizontal section at line 4—4 of FIG. 1.
Figure 5:
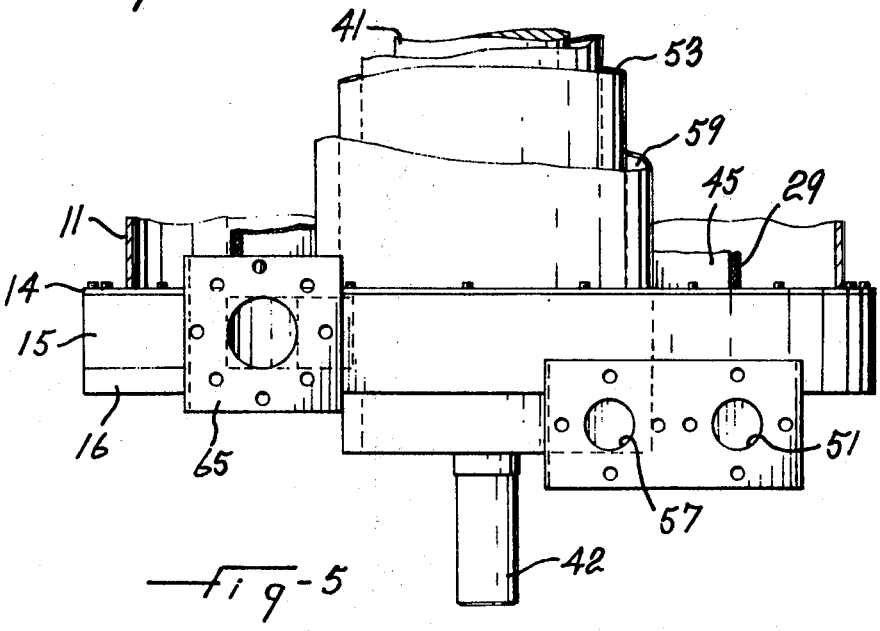
FIG. 5 is a side elevation partly in section of the lower portion of the pulp screening device looking in the direction of arrow 5 in FIG. 4.

In the cylindrical housing 11 spaced down from the top flange 13 is a disc ring 17 which divides the housing into an upper inlet chamber 18 above the disc ring 17 and a lower screening chamber 19 below the disc ring 17. A tubular inlet pipe 20 having a flange 21 at the end thereof provides entry to a volute casing 22 which in the embodiment shown has a rectangular cross section as is illustrated in FIG. 3. The shape of the cross section, be it rectangular, round, triangular or other is but a matter of choice and not an essential feature of the invention. The volute casing 22 has a top surface 23 and a bottom surface 24. When a stone trap is provided as in the device shown in FIGS. 2 and 3, the volute bottom surface 24 stays substantially horizontal and the top surface 23 slopes downwards. When no stone trap is provided, the volute top surface 23 stays substantially horizontal and the bottom surface 24 slopes upward. In this manner, the cross section of the volute casing 22 remains substantially square. At the top of the volute casing 22 is an entry slot or inlet aperture 25 in the cylindrical housing 11 which extends around at least a portion of the periphery of the cylindrical housing 11. The aperture 25 extends around the periphery for a sufficient distance to allow pulp slurry to flow into the inlet chamber 18 without restriction. The total area of the inlet aperture 25, is generally ruled by the quantity of slurry entering the upper inlet chamber 18. The size of the aperture 25 also takes into consideration the requirements of a low flow velocity so that heavy objects do not pass into the upper inlet chamber. This aperture 25 also allows the pulp slurry to enter the inlet chamber 18 so that no swirling or vortex effect occurs in the inlet chamber 18. At the end of the volute casing 22 is a stone trap 25A to catch stones or other large objects which do not pass through the aperture 25. The stone trap 25A has a first gate valve 25B and a second gate valve 25C with a chamber 25D therebetween. A dilution water purge 25E is provided to supply elutriation water to flush good fiber away from the stone trap 25A and thus facilitate the entry of heavy tramp materials. It is also useful to clean out the chamber 25D when the second gate valve 25C is open.

A conical inlet ring 26 has a lower flange 27 at its largest diameter which rests on the disc ring 17. The flange 27 overlaps the disc ring 17 so that pulp slurry passing into the inlet chamber 18 must move up the conical side of the inlet ring 26 and pass over the small diameter lip 28 flowing downwards through the conical inlet ring 26 into the agitated interior of the lower chamber 19, through a cylindrical screen plate 29 into an accepts chamber 30. The small diameter lip 28 gives the pulp slurry a high axial velocity into the lower chamber 19. The conical inlet ring 26 extends upwards well above the inlet aperture 25 so that the inlet aperture 25 is always submerged and the pulp slurry entering the inlet chamber 18 always has to rise upwards and pass over the lip 28 of the conical inlet ring 26. There is always an even flow of pulp slurry all around the lip 28, and the screening device can operate at a static head as low as one or two feet. In the embodiment shown, a vortex breaker 31 in the form of two vertical plates in the shape of a cross is inserted in the conical inlet ring 26 to ensure a smooth flow and prevent swirling of the pulp slurry as it passes over the lip 28 and drops into the lower chamber 19. The vortex breaker 31 may be omitted in some cases where there is no swirling occurring in the ring 26.

The cylindrical screen plate 29 is mounted axially within the lower chamber 19 and extends for the full height of the chamber. A tangential outlet 33 at the bottom of the lower chamber 19 in the cylindrical housing 11 outside the screen 29 allows the screened fibers to leave the screening device 10. A flange 34 at the end of the outlet 33 provides a connection to discharge ducts.

A rotary impeller 36 is positioned axially within the screen 29. The rotary impeller 36 is shaped in or approximately in the form of a paraboloid. In the embodiment shown the paraboloid has been formed from a series of truncated cones joined together and with a curved nose cone on top. The impeller is made in this manner for ease of construction but the approximate paraboloid shape is the important feature of the impeller. In the embodiment shown, the tip of the impeller nose cone is substantially level with the top of the screen 29. The impeller 36 as shown in FIG. 1 extends substantially the full height of the screen 29. In other embodiments the impeller 36 may extend above the top of the screen into the conical ring 26 or may not extend for the full height of the screen 29 in which case the tip of the impeller nose cone is below the top of the screen 29.

The rotary impeller 36 is mounted on a rotating axial shaft 40 which rotates in a bearing assembly 41 on the axis of the cylindrical screening device 10. The lower driving end 42 of the shaft may have a V-belt pulley (not shown) mounted thereon for connection by means of V-belts to an electric motor.

A number of impeller blades 43 are equispaced about the rotary impeller 36 and attached thereto. As shown in FIG. 1, the impeller blades 43 extend in the proximity of the screen for the full height of the screen. Each impeller blade 43 may be a single blade as shown or formed in sections. The blades 43 are attached to the rotary impeller but do not extend up to the nose cone of the impeller leaving a space above the nose cone of the impeller 36 to the conical ring 26 free of blades so that there is a gradual increase in radial velocity in the pulp slurry as it enters the screening chamber 19 and flows towards the screen 29. This gradual increase in radial velocity avoids plugging of the pulp fibers at the top of the screen 29. The blades 43 extend up from the connection on the impeller 36 to an annular rotating ring 44 which joins all the tips of the impeller blades 43 together at the top of the cylindrical screen 29. The annular ring 44 has an inside diameter which is greater than the inside diameter of the conical inlet ring 26. Thus, the annular ring 44 does not prevent the pulp slurry passing from the inlet ring 26 into the lower chamber 19. When the pulp slurry first enters the lower chamber 19 it is deflected by the nose cone of the impeller to the inside surface of the cylindrical screen 29 and the radial velocity gradually increases as the impeller blades 43 rotate the pulp slurry.

Figure 7:
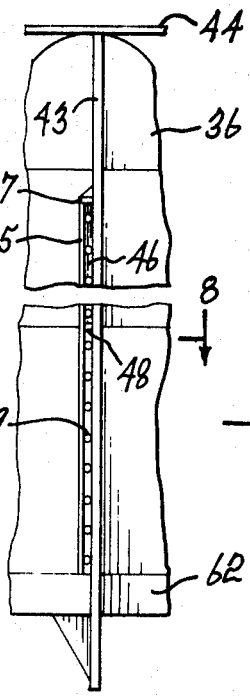
FIG. 7 is a vertical elevation of one pair of impeller blades at line 7—7 of FIG. 4.
Figure 8:
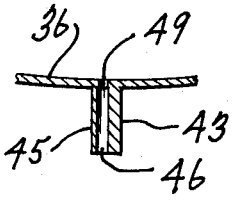
FIG. 8 is a horizontal section at line 8—8 of FIG. 7.

As shown in more detail in FIGS. 7 and 8, a series of second blades 45 are attached to the impeller 36 up to the connection of the impeller blades 43. These second blades 45 are positioned adjacent the impeller blades 43 leaving gaps 46 therebetween to form pairs of blades. A top plate 47 positioned across the gap 46 between each pair of blades is located at the top of the blades and a middle plate 48 positioned across the gap 46 is located approximately mid way down the blades. The impeller blades 43 and second blades 45 both extend the same distance to within close proximity of the screen 29. A plurality of holes 49 are provided in the impeller body 36 between the pair of blades above and below the middle plate 48 and act as dilution sprays so that water passing through these holes is directed at the screen 29.

FIGS. 1 to 6 show a first and second dilution water system for the impeller 36. The first dilution water system has a flanged water inlet 51 and a water inlet duct 52 leading to an inner annular chamber 53 surrounding the bearing assembly 41 for the shaft 40. The inner annular chamber 53 leads the dilution water up to the interior of the impeller 36. The water exits from the inner annular chamber 53 by a plurality of holes 54 in the top and/or side surface of the inner annular chamber 53. The water then passes out through the holes 49 in the peripheral wall of the impeller 36 filling the gap 46 between the pair of blades 43 and 45 above the middle plate 48 and flowing outward to the screen plate 29. Inside the impeller 36 there is an annular rotating dividing ring 55 dividing the first and second dilution water systems. The dividing ring 55 is joined to the inside peripheral wall of the impeller 36 which rotates adjacent to a stationary dividing ring 56 joined to the outside surface of the inner annular chamber 53. A small clearance is provided between the rotating ring 55 and stationary ring 56 so that little or no dilution water can pass between the first and second dilution water systems. In a preferred embodiment a labyrinth seal may be used between the rotating ring 55 and stationary ring 56.

The second dilution water system has a flanged water inlet 57 and a water inlet duct 58 leading to an outer annular chamber 59 surrounding the inner annular chamber 53 but extending up only into the interior of the lower portion of the impeller 36. Holes 60 on the top and/or side surface of the outer annular chamber 59 allow dilution water to flow into the lower portion and exit through the holes 49 in the peripheral wall of the impeller into the gap 46 between the pairs of blades 43 and 45 below the middle plate 48 and thus flow outward to the screen plate 29. In a preferred embodiment, a labryrinth seal 61 may be used at the base of the lower section 39 to restrict the flow of dilution water at the base of the impeller 36.

In a preferred embodiment the lower portion 62 on the peripheral wall of the impeller 36 is cylindrical so that the remaining slurry containing the rejects does not speed up as it passes this lower portion 62 of the impeller 36 and drops into the reject chamber 63.

Figure 6:
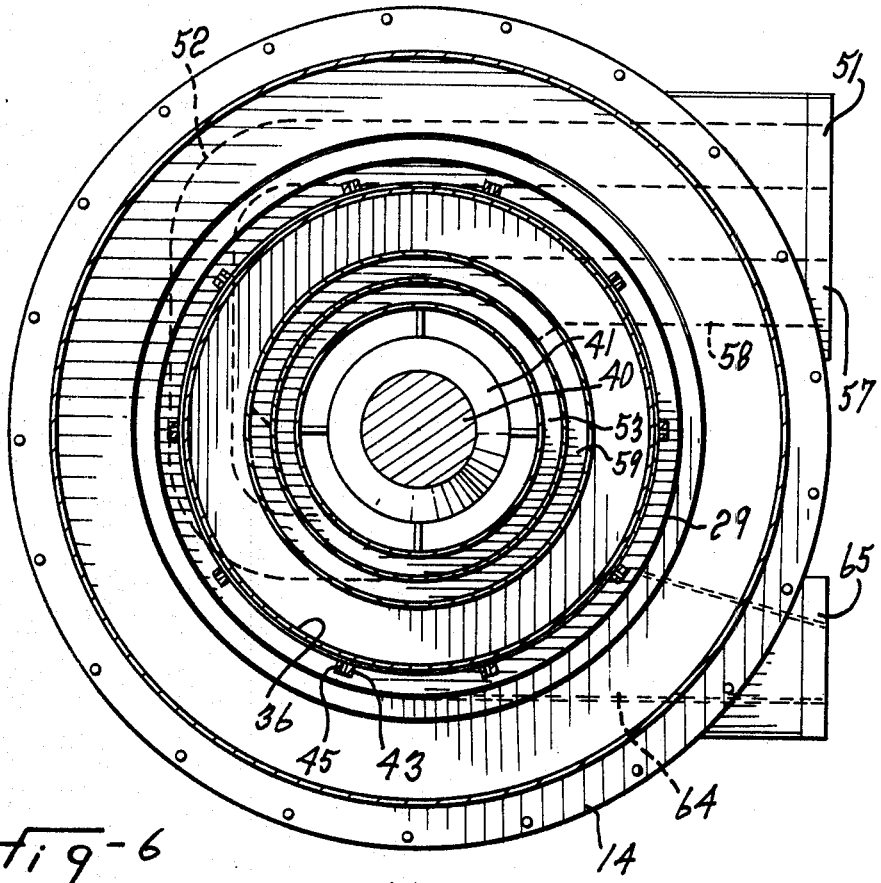
FIG. 6 is a horizontal section at line 6—6 of FIG. 1.

The reject chamber 63 is contained within the reject chamber module 15 and at least one of the impeller blades 43 extends down into the reject chamber 63 to ensure that the reject chamber is continually being swept. A tangential reject outlet 64 is shown in FIG. 6 for the reject chamber 63 terminating at a flange outlet 65 to aid in pumping the rejects out of the reject chamber 63 and preventing plugs occurring in the reject chamber 63.

In another embodiment a reject discharge housing and discharge pipe such as that shown in U.S. Pat. No. 3,713,536 may be used for the reject material. Dilution water may be introduced into the reject chamber 63, either axially or tangentially to aid in removing rejects.

In operation of the pulp screening device, pulp slurry is passed through the inlet pipe 20 into the volute casing 22 where it rises up to pass through the inlet aperture 25. There is a change in velocity of the pulp slurry as it passes through this inlet aperture 25, and the speed of the pulp slurry slows down to permit stones and other heavy objects to drop into the stone trap 25A. The pulp slurry rises up the sides of the conical inlet ring 26, flowing over the lip 28 and down into the screening chamber 19. As the pulp slurry flows through the inlet ring 26, the vortex breaker 31 ensures that little or no swirling occurs and therefore no vortex is formed as the pulp slurry passes into the lower chamber 19.

The shape of the impeller 36 approximately in the form of a paraboloid deflects the pulp slurry towards the sides of the impeller 36 so little or no turbulence occurs in the flow of the pulp slurry passing into the screening area. As the pulp slurry moves to the screen surface, the impeller blades 43 rotate the pulp slurry and a normal screening action occurs with the blades 43 rotating the pulp slurry and forming a mat of pulp fibers between the edges of the blades 43 and the screen 29. This mat rotates relative to the screen and also has an axial movement downwards towards the reject chamber 63. Due to the rotational and axial movement of the mat, a shearing force occurs between one side of the mat and the tips of the impeller blades 43 which controls the thickness of the mat and tends to prevent the holes in the cylindrical screen plate 29 from plugging. The acceptable pulp fibers pass through the fiber mat which is formed by the rejectable shives and acceptable fibers and then through the screen plate 29 into the accepts chamber 30. As the mat moves down the screen plate 29, dilution water first of all from the first dilution system and then the second dilution system completes the screening operation. By having a plurality of different areas on the impeller 36 for a plurality of dilution water systems, it is possible to have separate dilution water supplies, one supply may be at a higher pressure or higher flow than the other supplies to ensure maximum efficiency of screening. The rejects pass into the reject chamber 63 where they are ejected through the outlet 64. The screened pulp passes out of the housing 10 through the outlet 33 for further processing.

The modular reject chamber 15 which is a preferred embodiment permits the cylindrical housing 11, pulp screen 29 and impeller 36 to be removed to allow for a complete change of modular reject chamber 15. The tangential outlet, also a preferred embodiment, permits ease of maintaining the module inasmuch as plugging is not so likely to occur within the reject chamber.

Figure 9:
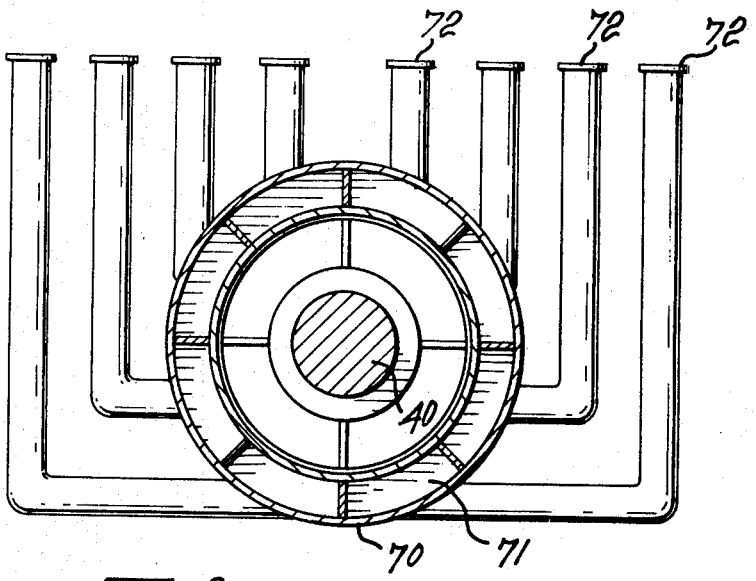
FIG. 9 is a partial horizontal section showing a plurality of conduits for dilution systems about the drive shaft of an impeller for another embodiment of the screening device of the present invention.
Figure 10:
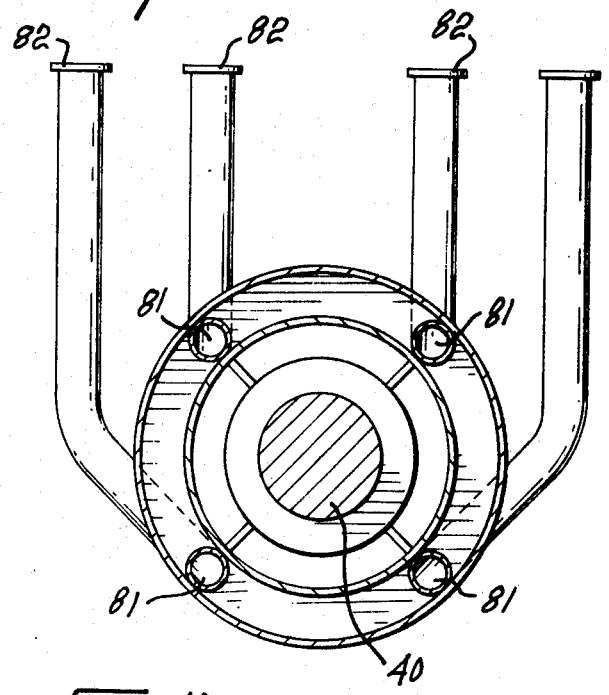
FIG. 10 is a partial horizontal section showing a different embodiment of a plurality of conduits for dilution systems about the drive shaft of an impeller.

FIG. 9 shows an annular chamber 70 surrounding the shaft 40 which is divided into a series of compartments 71. Each compartment 71 is connected to a separate water supply 72. Each compartment connects to an internal portion of the impeller which diverts dilution water to a specific area on the pulp screen. FIG. 10 shows another configuration of separate dilution water systems wherein a plurality of pipes 81 extend upwards within the impeller. Each pipe 81 terminates at different elevations thus providing dilution water to a specific area of the pulp screen. Each of the pipes 81 is connected to a separate water supply 82. Different types of nozzles to the pair of blades shown in FIGS. 7 and 8 may be used for supplying water to the screen. For example, a thicker blade with radial holes extending through each blade to the internal portion of the rotor may be employed or other systems which apply the water to the screening surface.

Figure 11:
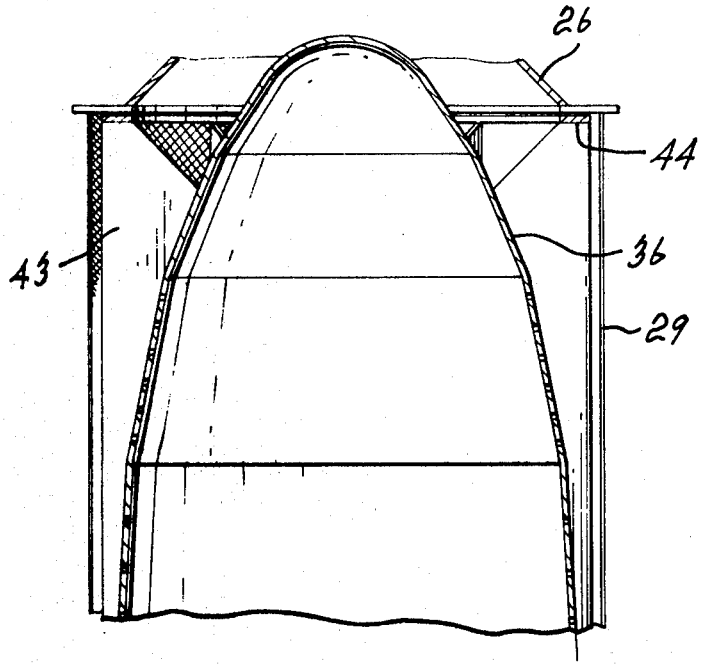
FIGS. 11 and 12 are partial vertical sections showing different arrangements of an impeller and screen.
Figure 12:
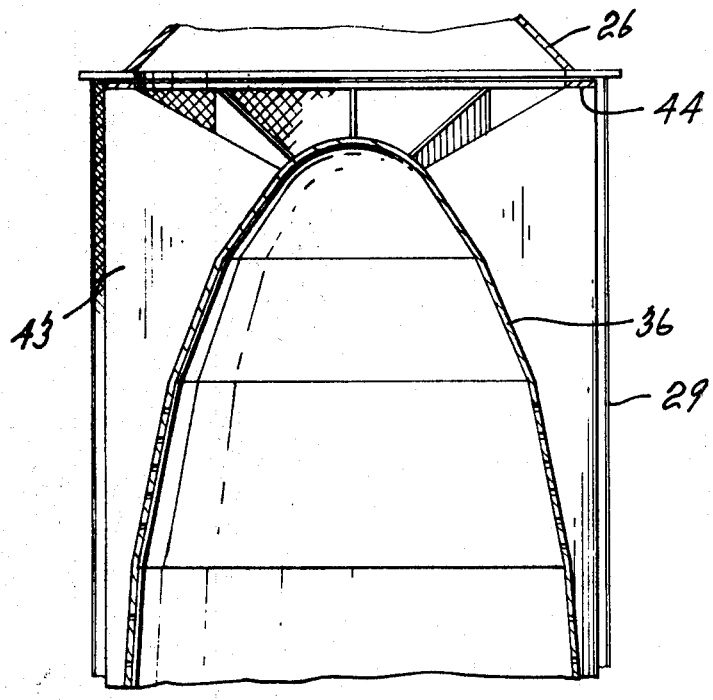

An impeller 36 in FIG. 11 is shown longer than the pulp screen 29 with the nose cone extending above the top of the screen 29, and FIG. 12 shows an impeller 36 shorter than the pulp screen 31 with the tip of the nose cone below the top of the screen 31.

It will be apparent to those skilled in the art that changes and variations may be made to the pressure pulp screen device of the present application without departing from the scope of the present invention which is only limited by the claims.

The embodiments of the invention in which an exclusive property or privilege is claimed are defined as follows:

1. A rotary pulp screening device of the vertical pressure type comprising cylindrical housing having an upper inlet chamber and a lower screening chamber with a disc ring dividing the upper chamber from the lower chamber, inlet aperture in the upper chamber, cylindrical screen mounted within the lower chamber, said disc ring providing an entrance inlet to said lower screening chamber, said entrance inlet being of substantially the same diameter as said cylindrical screen, rotary impeller mounted for rotation about a central vertical axis within the screen, the impeller having an approximately parabolid shaped body, said paraboloid shaped body directing pulp stock against the cylindrical screen along the full length of the screen, means for rotating the impeller, impeller blades radiating from at least a portion of the paraboloid shaped body and extending to within a short distance of the screen over the length of the screen, dilution means disposed within the cylindrical screen for controlling the consistency of pulp stock along the vertical length of the screening chamber, and pulp discharge outlet from the lower chamber outside the pulp screen.

2. The device according to claim 1 wherein the inlet aperture extends around at least a portion of the periphery of the cylindrical housing and including a conical inlet ring in the upper chamber extending upwards from the disc ring, the inlet ring having its smallest diameter at a top circular lip being at a level completely above the inlet aperture and spaced from a top surface of the cylindrical housing to provide an entry to the lower chamber between the circular lip and the top surface of the housing.

3. The device according to claim 2 including a vortex breaker means within the conical ring in the upper chamber.

4. The device according to claim 3 wherein the vortex breaker means includes at least one vertical plate positioned in the conical inlet ring.

5. The device according to claim 2 including a volute casing surrounding the inlet aperture of the cylindrical housing, and a stone trap attached at a lower portion of the volute casing.

6. The device according to claim 2 wherein the impeller blades radiate from the sides of the impeller omitting a tip portion of the impeller, the impeller blades extend upwards terminating in a rotating ring adjacent the upper end of the cylindrical screen, and wherein the inner diameter of the rotating ring is at least as large as the largest diameter of the conical inlet ring.

7. The device according to claim 1 including a reject chamber below the cylindrical housing and cylindrical screen having reject chamber impeller blades therein extending from at least one of the impeller blades radiating from the impeller, the reject chamber having a tangential reject discharge.

8. The device according to claim 7 wherein the reject chamber is a separate module attached to the base of the cylindrical housing.

9. The device according to claim 1 wherein the rotary impeller has a cylindrical lower portion of the peripheral wall of the lower section.

10. The device according to claim 1 wherein the axial length of the rotary impeller extends for the length of the screen and the tip of the rotary impeller is level with the top of the screen.

11. The device according to claim 1 wherein the axial length of the rotary impeller extends beyond the length of the screen and the tip of the rotary impeller is above the top of the screen.

12. The device according to claim 1 wherein the axial length of the rotary impeller is shorter than the length of the screen, and the tip of the rotary impeller is below the top of the screen.

13. The device according to claim 1 wherein the impeller blades are located in pairs forming longitudinal nozzles through which dilution water from the first and second dilution systems is directed to the areas on the lower portion and mid portion of the screen.

14. The device according to claim 1 wherein a plurality of dilution systems each include a separate inlet and conduit means to a separate section within the rotary impeller and including nozzle means from each separate section directing dilution water onto an area of the screen.

15. The device according to claim 1 wherein the first dilution system includes a first dilution water inlet leading to an inner annular chamber about the central vertical axis, the inner annular chamber feeding dilution water into a first section of the impeller and including nozzle means from the first section directing dilution water to the area on the mid portion of the screen, and the second dilution system includes a second dilution water inlet leading to an outer annular chamber about the inner annular chamber, the outer annular chamber feeding dilution water into a second section of the impeller and including nozzle means from the second section directing dilution water to the area on the lower portion of the screen.

16. A rotary pulp screening device of the vertical pressure type comprising, cylindrical housing having an upper inlet chamber and a lower screening chamber with a disc ring dividing the upper chamber from the lower chamber, inlet aperture in the upper chamber, cylindrical screen mounted within the lower chamber, rotary impeller mounted for rotation about a central vertical axis within the screen, the impeller having an approximately paraboloid shaped body, means for rotating the impeller, impeller blades radiating from at least a portion of the paraboloid shaped body and extending to within a short distance of the screen over the length of the screen, at least two dilution systems for directing dilution water from within said screening chamber between said impeller blades directly onto two different fiber screening areas on the axial height of the screen, one dilution system being disposed adjacent the lower end of the screen and at least another dilution system being disposed above said one dilution system, and pulp discharge outlet from the lower chamber outside the pulp screen.

17. A rotary impeller adapted to rotate inside of a cylindrical screen of a pulp screening device of the vertical pressure type, the impeller comprising, an approximately paraboloid shaped body;

impeller blades radiating from at least a portion of said paraboloid shaped body and extending to within a short distance of the screen over the length of the screen; and at least two dilution systems for direction dilution water from within said cylindrical screen between said impeller blades directly onto two different fiber screening areas on the axial height of the screen, one dilution system being disposed adjacent the lower end of the screen and at least another dilution system being disposed above said one dilution system.

18. A rotary impeller as claimed in claim 17 wherein the impeller blades radiate from the sides of the impeller omitting a tip portion and the impeller blades extend upwards terminating in a rotating ring adjacent the upper end of the cylindrical screen.

19. A rotary impeller as claimed in claim 17 wherein the impeller blades are located in pairs forming longitudinal nozzles for directing the respective dilution water to areas on the lower portion and midportion of the screen.

* * * * *